United States Patent [19]

Gauld et al.

[11] 4,234,417

[45] Nov. 18, 1980

[54] FIBROUS STOCK SCREEN

[75] Inventors: W. Thomas Gauld; Eigild S. Thomsen, both of Mobile, Ala.

[73] Assignee: Gauld Equipment Manufacturing Co., Theodore, Ala.

[21] Appl. No.: 25,285

[22] Filed: Mar. 29, 1979

[51] Int. Cl.[3] ..... B07B 1/20

[52] U.S. Cl. ..... 209/306; 209/273; 209/379; 209/380; 210/415

[58] Field of Search ..... 209/273, 305, 306, 379, 209/380, 283; 210/415, 412–414

[56] References Cited

U.S. PATENT DOCUMENTS

| | | | |
|---|---|---|---|
| 987,657 | 3/1911 | Wagner | 209/273 |
| 1,973,864 | 9/1934 | Biffar | 209/273 |
| 2,678,732 | 5/1954 | Banks | 210/415 |
| 2,796,809 | 6/1957 | Sprau | 209/306 X |
| 3,145,165 | 8/1964 | Sandison | 209/306 X |
| 3,245,535 | 4/1966 | Cowan | 209/306 X |
| 3,367,506 | 6/1965 | Rosaen | 210/415 X |
| 3,637,077 | 1/1972 | Cowan | 209/306 X |
| 3,713,536 | 1/1973 | Hooper | 209/306 X |
| 3,785,495 | 1/1974 | Nolz | 209/306 |
| 3,914,172 | 10/1975 | McGuik | 209/306 X |

FOREIGN PATENT DOCUMENTS

| | | | |
|---|---|---|---|
| 1195088 | 6/1970 | United Kingdom | 209/306 |

*Primary Examiner*—Robert Halper

[57] ABSTRACT

An apparatus for screening fibrous stock. A rotor is rotatably mounted within an open ended, cylindrical screen which is mounted in a hollow housing. Fibrous stock is introduced into the housing and rotation of the rotor causes the portion of the fibrous stock that will pass through the screen to do so. Any fibrous stock that passes through the screen is discharged from the housing. The rotor includes a cylindrical body member having a plurality of blade members attached thereto and spaced substantially evenly about the circumference of the body member and radiating outwardly therefrom. Each blade member has a leading edge and a trailing edge with the leading edge spaced farther from the body member than the trailing edge.

12 Claims, 9 Drawing Figures

79
77'
79
77'
45
77'
79
47
47
77
65
69'
69'
77
77
V
V
75
65
71
69"
67
75
69"
65
71
73
75
75
69'''
69'''
71
65

49
45
47
55
49
75
53
71
73
63
67
75
51
65
57

FIBROUS STOCK SCREEN

BACKGROUND OF THE INVENTION

1. Field of the Invention

This invention relates generally to filtering devices and more specifically to apparatuses for screening fibrous stock.

2. Description of the Prior Art

The following patents relate generally to the present invention: Davis, U.S. Pat. No. 2,936,075; Cowan, U.S. Pat. No. 3,081,873; Cowan, U.S. Pat. No. 3,243,041; Cowan, U.S. Pat. No. 3,245,535; Hooper, U.S. Pat. No. 3,508,651; and Hooper, U.S. Pat. No. 3,713,536. None of the above patents disclose or suggest the present invention.

SUMMARY OF THE INVENTION

The present invention is directed towards improving upon prior apparatuses for filtering fibrous stock slurries. The concept of the present invention is to provide a fibrous stock screening apparatus with a rotor having a cylindrical body member and plurality of blade members attached to and spaced substantially evenly about the circumference of the body member and radiating outwardly therefrom with each blade member having a leading edge and a trailing edge and with the leading edge spaced farther from the body member than the trailing edge.

The apparatus of the present invention includes, in general, a hollow housing member having an inlet port for allowing fibrous stock to be introduced into the interior thereof and having an outlet port for allowing screened fibrous stock to be discharged therefrom; a cylindrical, open ended screen member positioned within the housing member, the housing member including structure means for fixedly mounting the screen member within the housing member and for isolating the outer side of the screen member to divide the interior of the housing member into a first chamber and a second chamber with the boundary between the first and second chambers defined in part by the screen member, the inlet port communicating directly with the first chamber and the outlet port communicating directly with the second chamber; and an impeller means for causing fibrous stock within the first chamber to pass through the screen member into the second chamber and out the outlet port, the impeller means including a rotatable shaft member located substantially along the longitudinal axis of the screen member, and including a rotor means, the rotor means including a cylindrical body member fixedly attached to the shaft member and including a plurality of blade members attached to and spaced substantially evenly about the circumference of the body member and radiating outwardly therefrom, each of the blade members having a leading side and a trailing side and having an outer side joining the leading and trailing side to form a leading edge where the leading side and the outer side join and to form a trailing edge where the trailing side and the outer side join, the leading edge being farther from the body member than the trailing edge.

DESCRIPTION OF THE PREFERRED EMBODIMENTS

Figure 1:
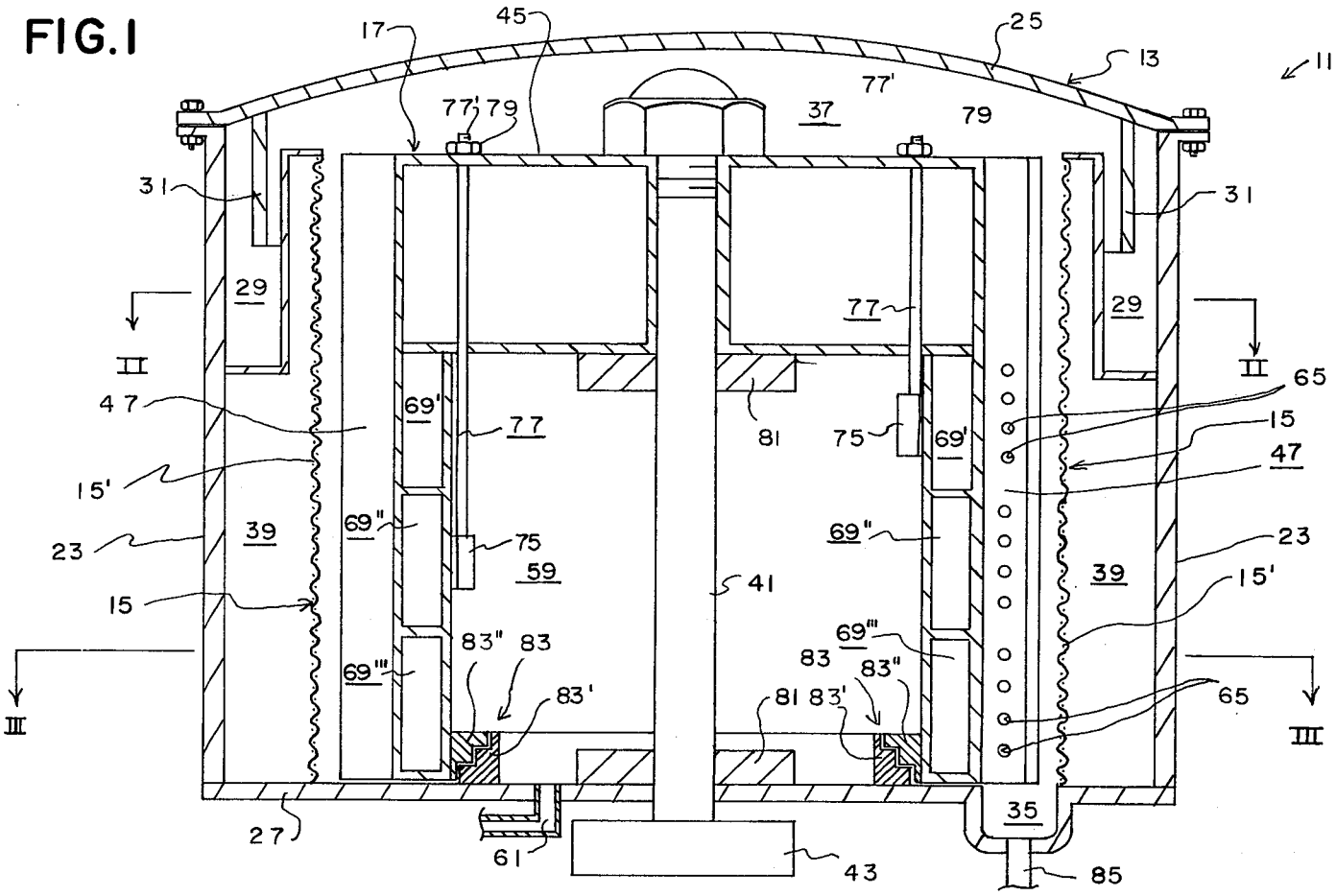
FIG. 1 is a sectional view of the apparatus for screening fibrous stock of the present invention.
Figure 2:
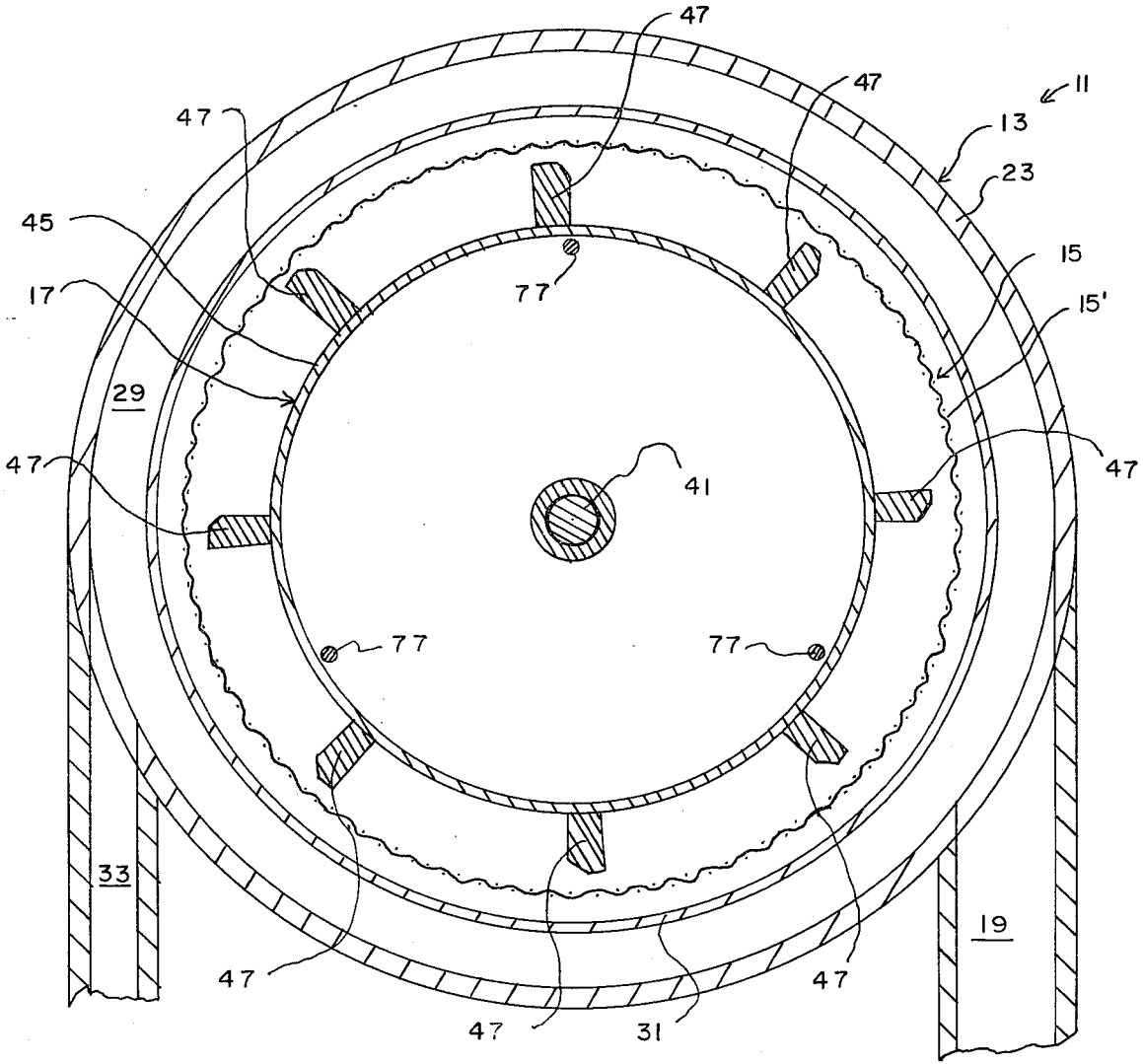
FIG. 2 is a sectional view as taken on line II—II of FIG. 1.
Figure 3:
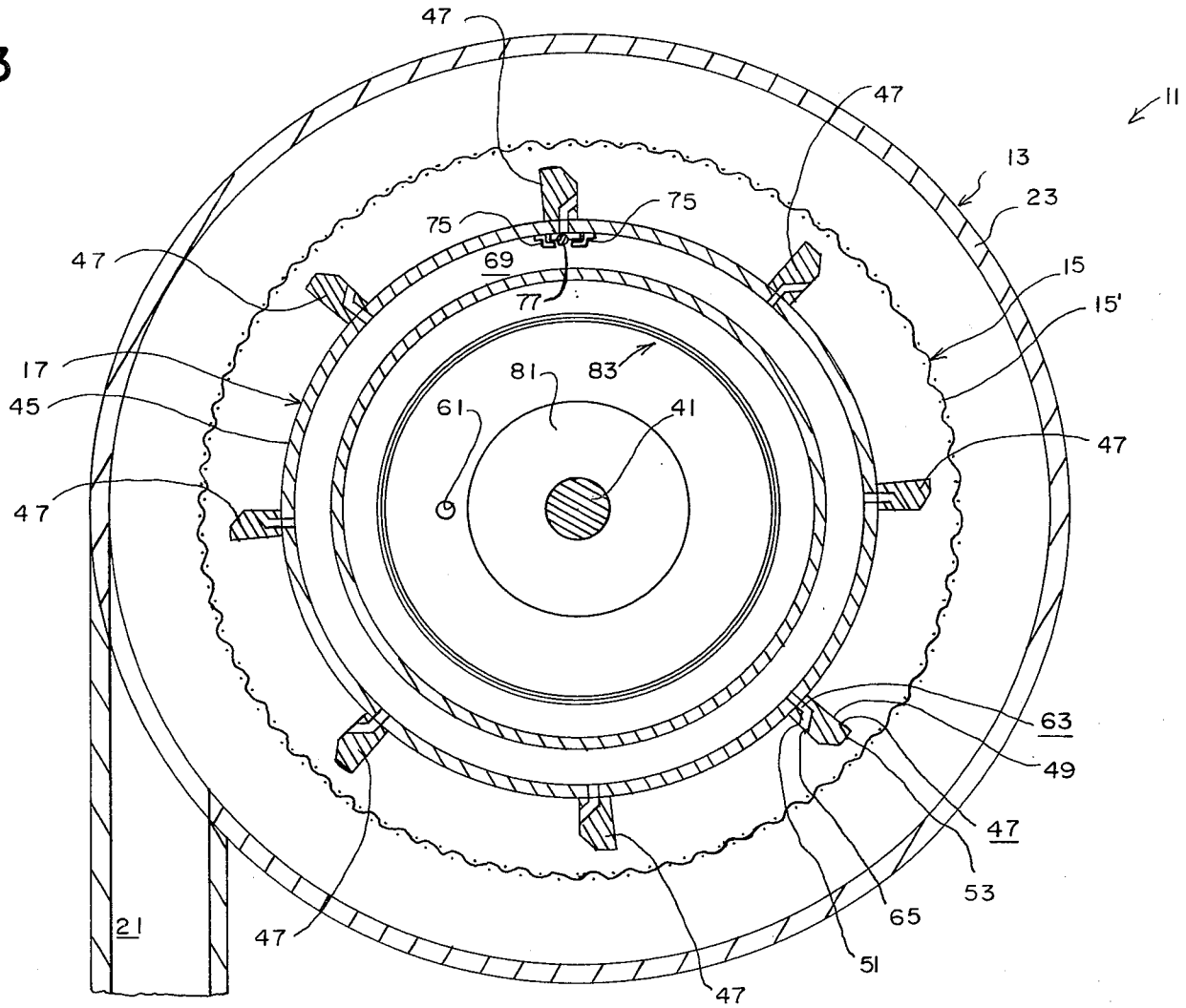
FIG. 3 is a sectional view as taken on line III—III of FIG. 1 with some parts removed for clarity.

The apparatus 11 is for screening fibrous stock slurries in order to separate any unacceptable, substantially large, substantially solid material therefrom. The apparatus 11 includes, in general, a hollow housing member 13, a cylindrical, open ended screen member 15 positioned within the housing member 13, and an impeller means 17 for causing fibrous stock to pass through the screen member 15 (see, in general, FIGS. 1, 2 and 3). The housing member 13 has an inlet port 19 for allowing fibrous stock to be introduced into the interior thereof and has an outlet port 21 for allowing screened fibrous stock to be discharged therefrom. The inlet and outlet ports 19, 21 are preferably located tangentially with respect to the inner surface of the outer wall of the housing member 13 as clearly shown in FIGS. 2 and 3 for reasons which will be apparent to those skilled in the art. The housing member 13 preferably includes an open ended cylindrical midportion 23, a first cover 25 attached to the midportion 23 for sealing one end thereof, and a second cover 27 associated with the midportion 23 for substantially sealing the other end thereof. The housing member 13 additionally preferably includes structure for defining an annular chamber 29 adjacent the inlet port 19 thereof and an annular baffle member 31 adjacent the annular chamber 29 for coacting together to cause any substantially heavy material in the fibrous stock being introduced into the interior of the housing member 13 through the inlet port 19 to fall to the lower portion of the annular chamber 29 (see, in general, FIG. 1). The housing member 13 also preferably includes an outlet port 33 communicating with the lower portion of the annular chamber 29 for allowing any unacceptable material separated from the fibrous stock by the annular chamber 39 and baffle member 31 to be removed from the housing member 13. The outlet port 33 is preferably located tangentially with respect to the inner surface of the outer wall of the housing member 13 as clearly shown in FIG. 3 for reasons which will be apparent to those skilled in the art. The housing member 13 also preferably includes an outlet port 35 substantially adjacent the second cover 27 for allowing any material in the fibrous stock that is not driven through the screen member 15 by the impeller means 17 or was not discharged through the outlet port 33 to be discharged therethrough.

The screen member 15 may be constructed of a metal plate having a plurality of apertures therethrough of a size for allowing acceptable portions of the fibrous stock to pass therethrough. The housing member 13 preferably includes structure means for fixedly mounting the screen member 15 within the housing member 13 for isolating the outer side 15' of the screen member 15 to divide the interior of the housing member 13 into a first chamber 37 and a second chamber 39 with the boundary between the first and second chamber 37, 39 defined in part by the screen member 15 (see, in general, FIG. 1). The inlet port 19 communicates with the first 37 by way of the chamber 29 and the outlet port 21 communicates directly with the second chamber 39 (see FIGS. 2 and 3) so that the fibrous stock is introduced through the inlet port 19 into the first chamber 37 and the impeller means 17 causes the acceptable portions of the fibrous stock within the first chamber 37 to pass through the screen member 15 into the second chamber 39 where it passes out the housing member 13 through the outlet port 21.

Figure 5:
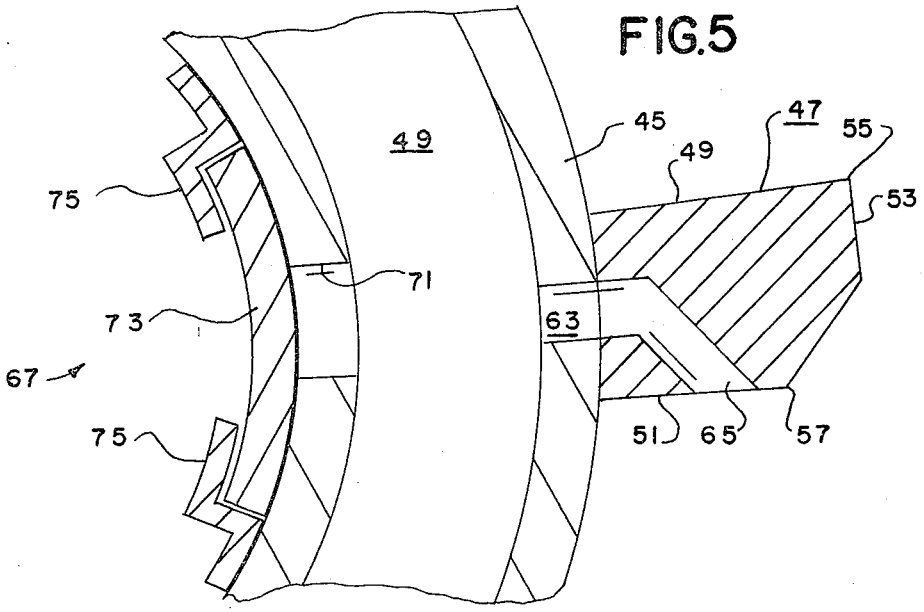
FIG. 5 is an enlarged sectional view as taken on line V—V of FIG. 4.
Figure 6:
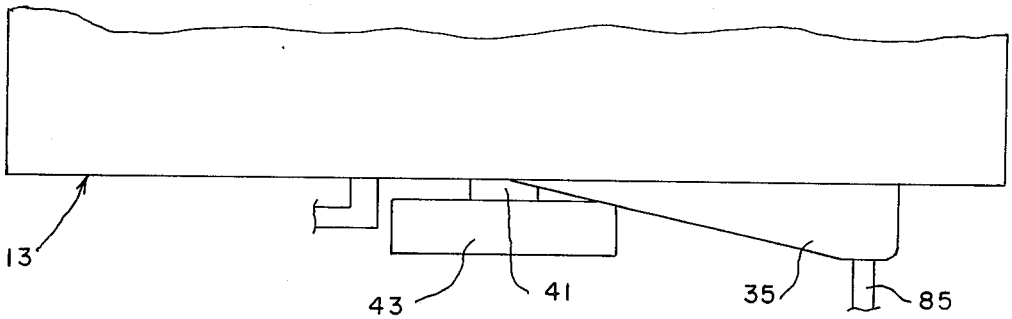
FIG. 6 is a right side elevational view of a portion of the apparatus of FIG. 1.
Figure 7:
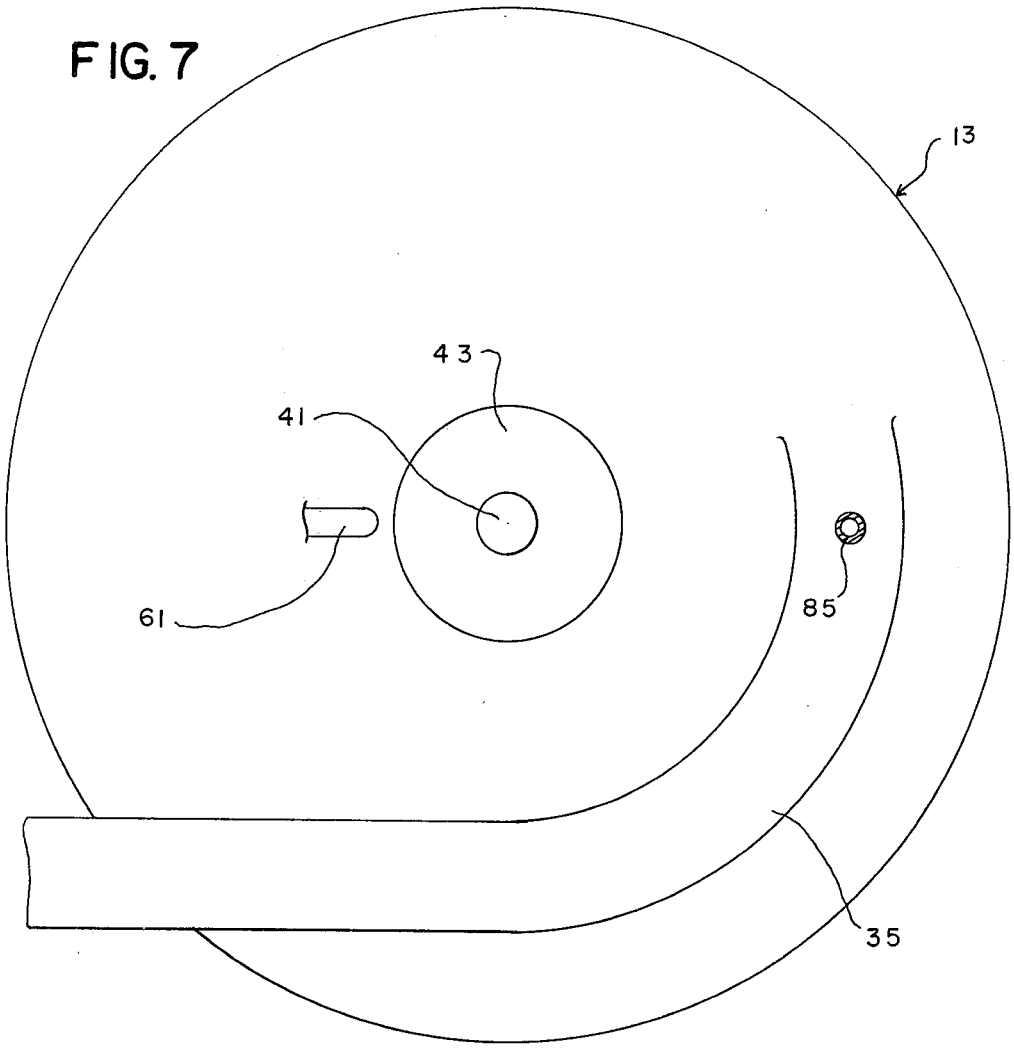
FIG. 7 is a bottom plan view of the apparatus of FIG. 1.

The impeller means 17 includes a rotatable shaft member 41 preferably extending through the second cover 27 into the interior of the housing member 13 substantially along the longitudinal axis of the screen member 15. The shaft member 41 is preferably rotatable driven in a manner apparent to those skilled in the art such as by being indirectly coupled to the output shaft of an electrical motor or the like (not shown) by way of a sheave 43 or the like. The impeller means 17 also includes a rotor means. The rotor means includes a cylindrical body member 45 fixedly attached to the shaft member 41 within the screen member 15. The rotor means also includes a plurality of blade members 47 attached to and spaced substantially evenly about the circumference of the body member 45 and radiating outwardly therefrom. Each blade member 47 has a leading side 49 and a trailing side 51 and has an outer side 53 joining the leading and trailing sides 49, 51 to form a leading edge 55 where the leading side 49 and the outer side 53 join and to form a trailing edge 57 where the trailing side 51 and the outer side 53 join (see, in general, FIG. 5). The leading edge 55 is farther from the body member 45 than the trailing edge 57. Thus, at least a portion of the outer side 53 of each blade member 47 slopes inwardly toward the body member 45 as it extends from the leading edge 55 to the trailing edge 57. The inwardly sloping angle of each blade member 47 minimizes the shear forces between the rotor means and screen member 15 and creates a pumping, lifting and pulling away action of the portions of the fibrous stock which will not pass through the screen to pull such portions of the fibrous stock away from the screen member 15 thereby preventing or helping to prevent the screen member 15 from clogged or the like.

The body member 45 preferably has a cavity 59 therein for receiving pressurized liquid. The housing member 13 includes an inlet port 61 for allowing pressurized liquid to be introduced into the cavity 59 from any typical source (not shown) of pressurized liquid. Each of the blade members 47 has an outlet port 63 communicating with the cavity 59 for allowing pressurized liquid to be discharged from the cavity 59 therethrough. Each of the outlet ports 63 has a discharge end 65 communicating with the trailing side 51 of the respective blade member 47. The discharge end 65 of each of the outlet ports 63 preferably angles away from the body member 45 to be thereby direct or impinge pressurized water against the screen member 15 at an angle from the trailing side 51 or trailing edge 57 of each blade member 47. Preferably each of the blade members 47 has a plurality of outlet ports 63. The rotor means preferably includes control means for controlling and varying the flow of pressurized liquid through the outlet ports 63 of the blade members 47. The control means preferably includes a plurality of valve means 67 for regulating the flow of pressurized liquid through the outlet ports 63 of the blade members 47 with each of the valve means 67 regulating the flow of pressurized liquid to a portion or stratum of the outlet ports 63 of a plurality of the blade members 47. The control means preferably includes a plurality of annular chambers 69 located within the cavity 59 of the body member 45 with each of the annular chambers 69 communicating with a portion or stratum of the outlet ports 63 of a plurality of the blade members 47 and being associated with at least one of the valve means 67 to form a number of screening zones so that the amount of pressurized liquid added to the various screening zones can be varied from the inlet end to the rejects end. More specifically, the body member 45 may include three annular chambers 69', 69'', 69''' having an aperture 71 communicating with the cavity 59 for allowing pressurized liquid to flow into each chamber 69', 69'', 69''' and with a valve means 67 associated with each apertuer 71 for controlling the flow of pressurized liquid therethrough. The valve means 67 may be of various construction. For example, each valve means 67 may include a plate-like member 73 slidably associated with each aperture 71 for selectively blocking portions or all of its associated aperture 71 to thereby control the flow of pressurized liquid therethrough. each valve means 67 may include guide members 75 assoicated with each plate member 73 for guiding the plate members 73 relative to the aperture 71. Each valve means 67 preferably includes means for remotely controlling the plate-like members 73. For example, each valve members 67 may include a rod-like member 77 fixedly attached to one end of each plate-like member 73 and extending upwardly through the body member 45 whereby each plate-like member 73 can be moved relative to each aperture 71 by manipulating the rod-like member 77 on the outside of the body member 45. For example, each rod-like member 77 may have a threaded end portion 77' and a nut member 79 may be associated therewith for causing the rod-like member 77 and, therefore, the plate-like member 73 to be moved up and down when the nut members 79 are rotated.

Figure 4:
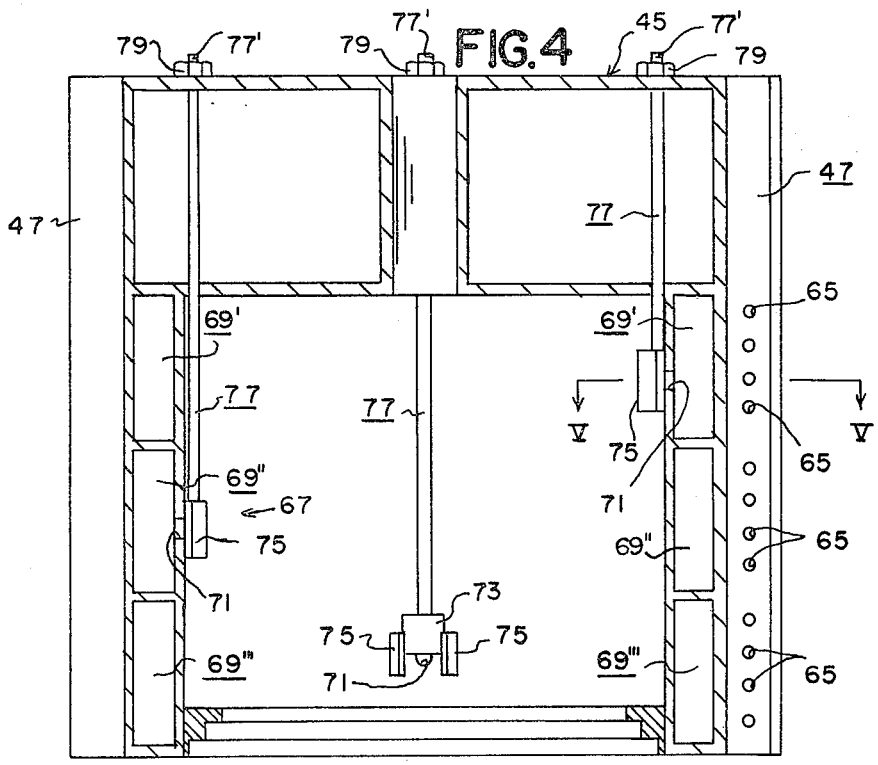
FIG. 4 is a vertical sectional elevational view of the rotor means of the apparatus for screening fibrous stock of the present invention.

Appropriate seal members 81 are associated with the shaft member 41 to provide a substantially liquid tight seal about the shaft member 41 within the cavity 59. The seal members 81 may be of any construction apparent to those skilled in the art. A labyrinthe seal means 83 may be associated with the second cover 27 and the body member 45 for providing a substantially liquid tight seal between the cavity 59 and the second cover 27. The labyrinthe seal means 83 may include a first ring member 83' attached to the second cover 27 of the housing member 13 and a second ring member 83'' attached to the body member 45 as clearly shown in FIGS. 1 and 4. The first and second ring members 83', 83'' have coacting stepped portions for providing a substantially liquid tight seal between the cavity 59 and the second cover 27 (see, in general, FIG. 1).

The use of the apparatus 11 of the present invention is as follows: fibrous stock is introduced into the first chamber 37 through the inlet port 19. The annular chamber 29 and baffle member 31 will cause various substantially heavy particulars of substantially solid material (i.e., material commonly referred to by those skilled in the art as "tramp metal") to separate from the fibrous stock and fall to the lower portions of the annular chamber 29 where it can be discharged therefrom through the outlet port 33. The remainder of the fibrous stock will then pass between the rotating body member 45 and the screen member 15. All acceptable portions of the pulp stock will be driven through the screen member 15 into the second chamber 39 by the rotor means as the fibrous stock falls towards the second cover 27 of the housing member 13. Any portion of the fibrous stock which does not pass through the screen member 15 will be discharged from the housing member 13 through the outlet port 35. An inlet port 85 may be coupled to the outlet port 35 for allowing pressurized liquid to pass into the outlet port 35 to aid in the discharge of the rejected portions of the fibrous stock.

Figure 8:
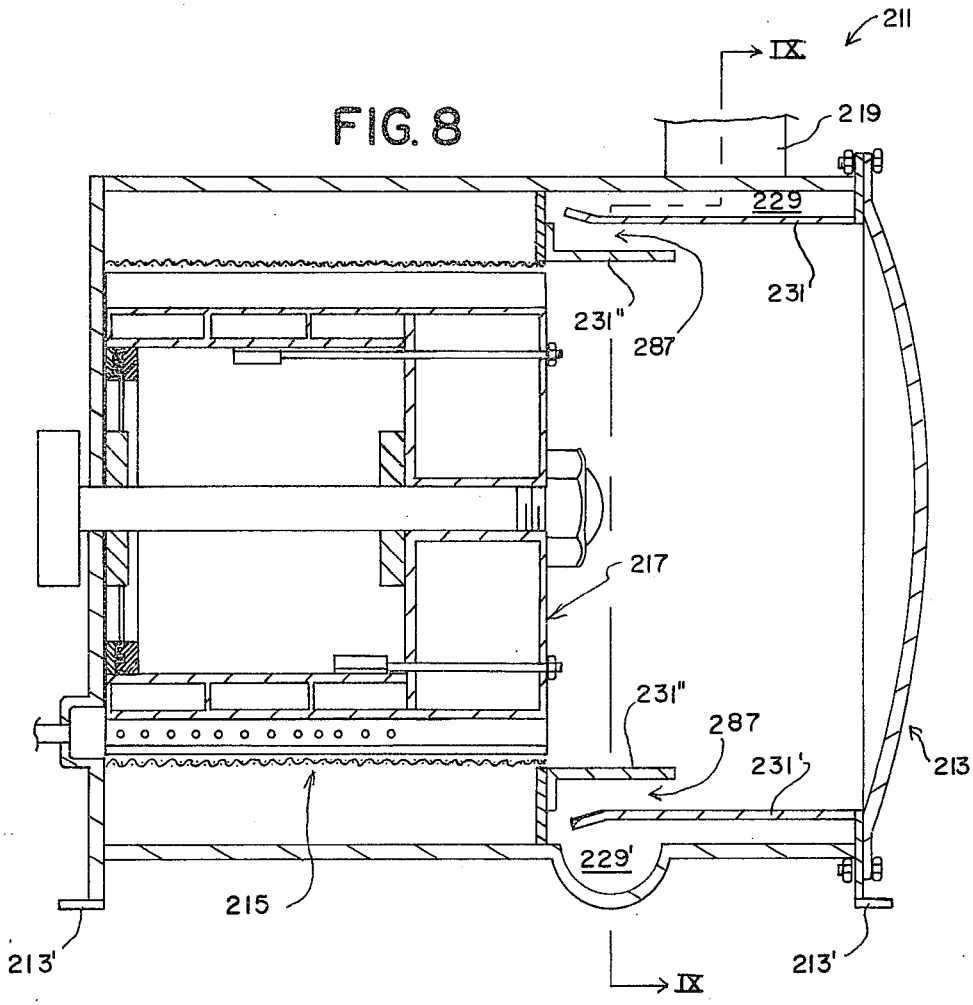
FIG. 8 is a sectional view of an alternate embodiment of the apparatus for screening fibrous stock of the present invention.
Figure 9:
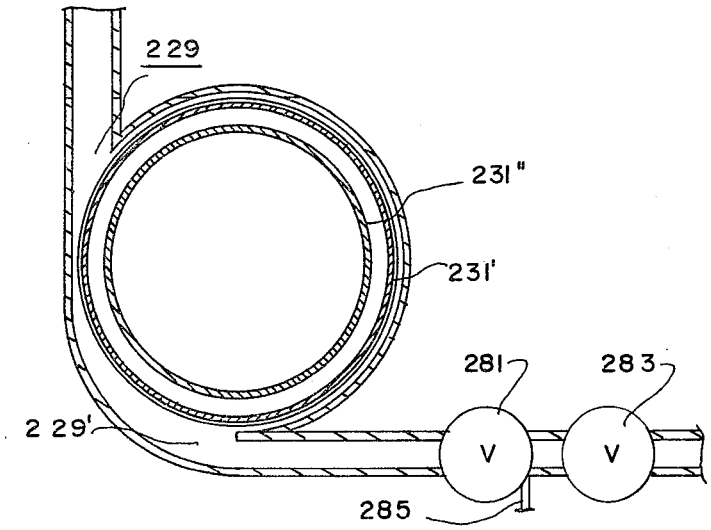
FIG. 9 is a sectional view as taken on line IX—IX of FIG. 8.

An alternate embodiment of the apparatus of the present invention is shown in FIGS. 8 and 9 and identified by the numeral 211. The apparatus 211 is substantially identical to the apparatus 11 in construction and operation. However, the apparatus 211 is designed specifically for use in a horizontal configuration. The apparatus 211 includes a hollow housing member 213 substantially identical to the hollow housing member 13 of the apparatus 11 but having feet portions 213' provided thereon for engaging a supporting surface such as the floor of a building or the like whereby the apparatus 211 is supported in a substantially horizontal configuration. The apparatus 211 includes a screen member 215 and an impeller means 217 that are substantially identical to the corresponding parts of the apparatus 11. Reference should be made to the above description of the apparatus 11 for further details on the specific construction and use of the apparatus 211. It should be noted that the apparatus 211 shown in FIGS. 8 and 9 discloses a modified means for removing any substantially heavy material from the fibrous stock being introduced into the interior of the housing member 213. More specifically, the housing member 213 is shown in FIG. 8 as including means for defining an annular chamber 229 adjacent the inlet port 219 and for defining first and second annular baffle members 231', 231'' adjacent the annular chamber 229 for coacting together to cause any substantially heavy material in the fibrous stock being introduced into the interior of the housing member 213 through the inlet port 219 to fall to the lower portion of the annular chamber 229. The lower portion of the annular chamber 229 preferably defines a trap portion 229'. The trap portion 229' is assoicated with a normally opened valve 281 and a normally closed valve 283 as shown in FIG. 9 whereby any heavy material so separated from the fibrous stock will normally accumulate between the valves 281, 283. To remove such accumulated material, the valve 281 is closed and the valve 283 is opened. Pressurized fluid is then introduced between the valves 281, 283 through an inlet 285 whereby such accumulated material is forced past the valve 283 as will now be apparent to those skilled in the art. The baffle members 231', 231'' coact to define a circumferentially restricted opening 287 to prevent material larger than a certain size from passing into the interior of the housing member 213.

As thus constructed and used, the present invention provides screening apparatus that will separate large material from small material in fibrous stock while efficiently removing debris material from the fibrous stock even when the size of the debris material is similar to the acceptable fiber and without sealing or clogging the screen member which could interrupt the screening operation. It should be noted that the present invention "screens" rather than "strains" the fibrous stock slurry. That is, when fibrous stock is properly "screened" solid material larger than a predetermined certain size and debris material of a size equal to or less than that predetermined certain size is removed from the fibrous stock. On the other hand, when fibrous stock is merely "strained," only solid material larger than a certain size is removed. To accomplish this "screening" of the fibrous stock, the rotor means of the present invention rotates a mat of stock more or less parallel to the inside of the screen member with a soft flow of acceptable portions of the fibrous stock through the screen member rather than "slinging" the fibrous stock against the inside of the screen member. The blade members causes the fibrous mat to move generally in the direction of rotation of the rotor means in relation to the screen member which is stationary. The shearing force developed is minimized by the sloping trailing edge of the blade members. There will be a relatively higher pressure at the leading edge followed by a relatively lower pressure from the trailing edge of each blade member. This movement of the fibrous mat or slurry keeps the screen member from sealing or blinding, thus maintaining a stable screening operation and the combination of a moving fibrous mat and varying pressures creates efficient screening in terms of separation of acceptable fiber and rejects.

Although the invention has been described and illustrated with respect to a preferred embodiment thereof, it is not to be so limited since changes and modifications may be made therein which are within the full intended scope of the invention.

We claim:

1. An apparatus for screening fibrous stock, said apparatus comprising: a hollow housing member having an inlet port for allowing fibrous stock to be introduced into the interior thereof and having an outlet port for allowing screened fibrous stock to be discharged therefrom; a cylindrical, open ended screen member positioned within said housing member; said housing member including structure means for fixedly mounting said screen member with said housing member and for isolating the outer side of said screen member to divide the interior of said housing member into a first chamber and a second chamber with the boundary between said first and second chambers defined in part by said screen member, said inlet port communicating directly with said first chamber and said outlet port communicating directly with said second chamber; and an impeller means for causing fibrous stock within said first chamber to pass through said screen member into said second chamber and out said outlet port, said impeller means including a rotatable shaft member located substantially along the longitudinal axis of said screen member and including a rotor means, said rotor means including a cylindrical body member fixedly attached to said shaft member and including a plurality of blade members attached to and spaced substantially evenly about the circumference of said body member and radiating outwardly therefrom, each of said blade members having a leading side and a trailing side and having an outer side joining said leading and trailing sides, said leading and trailing sides being parallel to one another, said outer side having a leading portion that is substantially perpendicular to said leading and trailing sides and having a trailing portion that slopes inwardly towards said body member, the intersection between said leading side and said outer side being farther from said body member than the intersection between said trailing side and said outer side. and said outer side being spaced from said screen member to permit forming of a mat of stock between said blade member and said screen member.

2. The apparatus of claim 1 in which said body member has a cavity, in which said housing member includes an inlet port for allowing pressurized liquid to be introduced into said cavity, and in which each of said blade members has an outlet port communicating with said cavity of said body member for allowing pressurized liquid to be discharged from said cavity therethrough, each of said outlet ports having a discharge end communicating with said trailing side of one of said blade members.

3. The apparatus of claim 2 in which said discharge end of said outlet ports of each of said blade members angles away from said body member.

4. The apparatus of claim 3 in which each of said blade members has a plurality of said outlet ports and in which said rotor means includes control means for controlling and varying the flow of pressurized liquid through each of said outlet ports of said blade members.

5. The apparatus of claim 4 in which said control means includes a plurality of valve means for regulating the flow of pressurized liquid through said outlet ports of said blade members, each of said valve means regulating the flow of pressurized liquid to a portion of said outlet ports of a plurality of said blade members.

6. An apparatus for screening fibrous stock, said apparatus comprising: a hollow housing member having an inlet port for allowing fibrous stock to be introduced into the interior thereof and having an outlet port for allowing screened fibrous stock to be discharged therefrom; a cylindrical, open ended screen member positioned within said housing member; said housing member including structure means for fixedly mounting said secreen member within said housing member and for isolating the outer side of said screen member to divide the interior of said housing member into a first chamber and a second chamber with the boundary between said first and second chambers defined in part by said screen member, said inlet port communicating directly with said first chamber and said outlet port communicating directly with said second chamber; and an impeller means for causing fibrous stock within said first chamber to pass through said screen member into said second chamber and out said outlet port, said impeller means including a rotatable shaft member located substantially along the longitudinal axis of said screen member and including a rotor means, said rotor means including a cylindrical body member fixedly attached to said shaft member and including a plurality of blade members attached to and spaced substantially evenly about the circumference of said body member and radiating outwardly therefrom, each of said blade members having a leading side and a trailing side and having an outer side joining said leading and trailing sides and forming a leading edge where said leading side and said outer side join and forming a trailing edge where said trailing side and outer side join, said leading edge being farther from said body member than said trailing edge; said body member having a cavity, said housing member including an inlet port for allowing pressurized liquid to be introduced into said cavity, each of said blade members having an outlet port communicating with said cavity of said body member for allowing pressurized liquid to be discharged from said cavity therethrough, each of said outlet ports having a discharge end communicating with said trailing side of one of said blade members; said discharge end of said outlet ports of each of said blade members angling away from said body member; each of said blade members having a plurality of said outlet ports, said rotor means including control means for controlling and varying the flow of pressurized liquid through each of said outlet ports of said blade members; said control means including a plurality of valve means for regulating the flow of pressurized liquid through said outlet ports of said blade members, each of said valve means regulating the flow of pressurized liquid to a portion of said outlet ports of a plurality of said blade members; said control means including a plurality of annular chambers located within said cavity of said body member, each of said annular chamber communicating with a portion of said blade members and being associated with at least one of said valve means.

7. An improved apparatus for screening fibrous stock of the type including a hollow housing member having an inlet port for allowing fibrous stock to be introduced into the interior thereof and having an outlet port for allowing screened fibrous stock to be discharged therefrom; a cylindrical, open ended screen member positioned within said housing member; said housing member including structure means for fixedly mounting said screen member within said housing member and for isolating the outer side of said screen member to divide the interior of said housing member into a first chamber and a second chamber with the boundary between said first and second chambers defined in part by said screen member, said inlet port communicating directly with said first chamber and said outlet port communicating directly with said second chamber; a rotatable shaft member located substantially along the longitudinal axis of said screen member; wherein the improvement comprises: a rotor means for causing fibrous stock within said first chamber to pass through said screen member into said second chamber and out said outlet port, said rotor means including a cylindrical body member fixedly attached to said shaft member for rotation therewith and including a plurality of blade members attached to and spaced substantially evenly about the circumference of said body member and radiating outwardly therefrom, each of said bade members having a leading side and a trailing side and having an outer side joining said leading and trailing sides, said leading and trailing sides being parallel to one another, said outer side having a leading portion that is substantially perpendicular to said leading and trailing sides and having a trailing portion that slopes inwardly toward said body member, the intersection between said leading side and said outer side being farther from said body member than the intersection between said trailing side and and said outer side being spaced from said screen member to permit forming of a mat of stock between said blade member and said screen member.

8. The improvement of claim 7 in which said body member of said rotor means has a cavity, in which said housing member includes an inlet port for allowing pressurized liquid to be introduced into said cavity, and in which each of said blade members of said rotor means has an outlet port communicating with said cavity of said body member for allowing pressurized liquid to be discharged from said cavity therethrough, each of said outlet ports having a discharge end communicating with said trailing side of one of said blade members.

9. The improvement of claim 8 in which said discharge end of said outlet ports of each of said blade members angles away from said body member.

10. The improvement of claim 9 in which each of said blade members has a plurality of said outlet ports and in which said rotor means includes control means for controlling and varying the flow of pressurized liquid through each of said outlet ports of said blade members.

11. The improvement of claim 10 in which said control means includes a plurality of valve means for regulating the flow of pressurized liquid through said outlet ports of said blade members, each of said valve means regulating the flow of pressurized liquid to a portion of said outlet ports of a plurality of said blade members.

12. An improved apparatus for screening fibrous stock of the type including a hollow housing member having an inlet port for allowing fibrous stock to be introduced into the interior thereof and having an outlet port for allowing screened fibrous stock to be discharged therefrom; a cylindrical, open ended screen member positioned within said housing member; said housing member including structure means for fixedly mounting said screen member within said housing member to divide the interior of said housing member into a first chamber and a second chamber with the boundary between said first and second chambers defined in part by said screen member, said inlet port communicating directly with said first chamber and said outlet port communicating directly with said second chamber; a rotatable shaft member located substantially along the longitudinal axis of said screen member; wherein the improvement comprises: a rotor means for causing fibrous stock within said first chamber to pass through said screen member into said second chamber and out said outlet port, said rotor means including a cylindrical body member fixedly attached to said shaft member for rotation therewith and including a plurality of blade members attached to and spaced substantially evenly about the circumference of said body member and radiating outwardly therefrom, each of said blade members having a leading side and a trailing side and having an outer side joining said leading and trailing sides and forming a leading edge where said leading side and said outer side join and forming a trailing edge where said trailing side and said outer side join, said leading edge being farther from said body member than said trailing edge; said body member of said rotor means having a cavity, said housing member including an inlet port for allowing pressurized liquid to be introduced into said cavity, each of said blade members of said rotor means having an outlet port communicating with said cavity of said body member for allowing pressurized liquid to be discharged from said cavity therethrough, each of said outlet ports having a discharge end communicating with said trailing side of one of said blade members; said discharge end of said outlet ports of each of said blade members angling away from said body member; each of said blade members having a plurality of said outlet ports, said rotor means including control means for controlling and varying the flow of pressurized liquid through each of said outlet ports of said blade members; said control means including a plurality of valve means for regulating the flow of pressurized liquid through said outlet ports of said blade members, each of said valve means regulating the flow of pressurized liquid to a portion of said outlet ports of a plurality of said blade members; said control means including a plurality of annular chambers located within said cavity of said body member, each of said annular chambers communicating with a portion of said blade members and being associated with at least one of said valve means.

* * * * *